US011114788B2

(12) United States Patent
Kim

(10) Patent No.: US 11,114,788 B2
(45) Date of Patent: Sep. 7, 2021

(54) PCB DIRECT CONNECTOR HAVING TWO-ROW TERMINAL STRUCTURE

(71) Applicant: LG Chem, Ltd., Seoul (KR)

(72) Inventor: Sung-Gyu Kim, Daejeon (KR)

(73) Assignee: LG Chem, Ltd.

( * ) Notice: Subject to any disclaimer, the term of this patent is extended or adjusted under 35 U.S.C. 154(b) by 0 days.

(21) Appl. No.: 16/759,423

(22) PCT Filed: May 9, 2019

(86) PCT No.: PCT/KR2019/005573

§ 371 (c)(1),
(2) Date: Apr. 27, 2020

(87) PCT Pub. No.: WO2019/240378

PCT Pub. Date: Dec. 19, 2019

(65) Prior Publication Data

US 2020/0274275 A1 Aug. 27, 2020

(30) Foreign Application Priority Data

Jun. 12, 2018 (KR) ..... 10-2018-0067735

(51) Int. Cl.
*H01R 12/77* (2011.01)
*H01R 12/58* (2011.01)
(Continued)

(52) U.S. Cl.
CPC ..... *H01R 12/774* (2013.01); *H01R 12/58* (2013.01); *H01R 12/7005* (2013.01);
(Continued)

(58) Field of Classification Search
CPC .. H01R 12/774; H01R 12/58; H01R 12/7005; H01R 12/716; H01R 13/502; H01R 13/629
See application file for complete search history.

(56) References Cited

U.S. PATENT DOCUMENTS 4,400,049 A 8/1983 Schuck
2006/0189195 A1 8/2006 Okada
(Continued)

FOREIGN PATENT DOCUMENTS

CN 208189901 U 12/2018
JP S50063593 U 6/1975
(Continued)

OTHER PUBLICATIONS

Extended European Search Report including Written Opinion for Application No. EP19818817.9 dated Nov. 26, 2020, 10 pgs.
(Continued)

*Primary Examiner* — Abdullah A Riyami
*Assistant Examiner* — Nader J Alhawamdeh
(74) *Attorney, Agent, or Firm* — Lerner, David, Littenberg, Krumholz & Mentlik, LLP

(57) ABSTRACT

A PCB direct connector is directly mounted to a circuit board, and the PCB direct connector includes terminal members arranged in two rows to respectively contact upper conductive patterns and lower conductive patterns provided to an upper surface and a lower surface of the circuit board, and a connector housing configured to accommodate the terminal members therein and allow a connector connection portion formed at one side of an end of the circuit board to be fitted into and released from the connector housing.

15 Claims, 6 Drawing Sheets

(51) Int. Cl.

| | |
|---|---|
| ***H01R 12/70*** | (2011.01) |
| ***H01R 12/71*** | (2011.01) |
| ***H01R 13/502*** | (2006.01) |
| ***H01R 13/629*** | (2006.01) |

(52) U.S. Cl.
CPC ..... *H01R 12/716* (2013.01); *H01R 13/502* (2013.01); *H01R 13/629* (2013.01)

(56) References Cited

U.S. PATENT DOCUMENTS

| | | | | |
|---|---|---|---|---|
| 2010/0255694 | A1 | 10/2010 | Kim et al. | |
| 2013/0040505 | A1 | 2/2013 | Hirakawa | |
| 2017/0187139 | A1 | 6/2017 | Dekoski et al. | |
| 2020/0274275 | A1* | 8/2020 | Kim ..... | H01R 12/58 |
| 2020/0313324 | A1* | 10/2020 | Kim ..... | H01R 13/24 |

FOREIGN PATENT DOCUMENTS

| | | | | | |
|---|---|---|---|---|---|
| JP | S5498986 | A | | 8/1979 | |
| JP | H05211082 | A | | 8/1993 | |
| JP | H06060082 | U | | 8/1994 | |
| JP | H07312265 | A | * | 11/1995 | ..... H01R 13/73 |
| JP | H07312265 | A | | 11/1995 | |
| JP | 2002324607 | A | | 11/2002 | |
| JP | 2006236657 | A | | 9/2006 | |
| JP | 2007214087 | A | | 8/2007 | |
| JP | 2009043489 | A | | 2/2009 | |
| JP | 2011146273 | A | | 7/2011 | |
| JP | 2012243562 | A | | 12/2012 | |
| JP | 2016127184 | A | | 7/2016 | |
| KR | 20070000740 | A | | 1/2007 | |
| KR | 20100046911 | A | | 5/2010 | |
| KR | 20100110023 | A | | 10/2010 | |
| KR | 101400463 | B1 | | 5/2014 | |
| KR | 101562810 | B1 | | 11/2015 | |
| KR | 20160085531 | A | | 7/2016 | |
| KR | 20170003725 | A | | 1/2017 | |
| WO | 2018101910 | A1 | | 6/2018 | |

OTHER PUBLICATIONS

International Search Report from Application No. PCT/KR2019/005573 dated Aug. 26, 2019, 2 pages.

Search Report from Office Action for Chinese Application No. 201980011670.4 dated Mar. 29, 2021; 2 pages.

* cited by examiner

PCB DIRECT CONNECTOR HAVING TWO-ROW TERMINAL STRUCTURE

CROSS-REFERENCE TO RELATED APPLICATIONS

The present application is a national phase entry under 35 U.S.C. § 371 of International Application No. PCT/KR2019/005573 filed May 9, 2019, published in Korean, which claims priority from Korean Patent Application 10-2018-0067735 filed Jun. 12, 2018, all of which are incorporated herein by reference.

TECHNICAL FIELD

The present disclosure relates to a connector, and more particularly, to a connector that may be directly coupled to a printed circuit board (PCB) substrate without a complementary connector and include a large number of terminals with a compact size.

BACKGROUND ART

Recently, electronic devices such as laptops, tablet PCs and smart phones as well as Battery Management Systems (BMS) used for charging or discharging products using secondary batteries have become increasingly compact and lightweight, and accordingly the density of electronic elements mounted to a circuit substrate thereof is also increasing. Thus, there is a demand for light, thin, short and small connector devices.

As shown in FIG. 1, a conventional connector generally includes a female connector 3 and a male connector 2 in a pair. The female connector 3 has a plurality of pins corresponding to a contact, and the male connector 2 has a plurality of plug terminals that come into contact with the plurality of pins. The male connector 2 is mounted to a circuit board 1*by* means of Surface Mounter Technology (SMT), and the female connector 3 is complementarily coupled with the male connector 2.

However, if both the female connector 3 and the male connector 2 are used, different bodies and contacts of the female connector 3 and the male connector 2 should be prepared using different molds, and any one connector must be surface-mounted to a circuit board, which makes the manufacturing process complicated and increases the manufacturing cost.

As an alternative of the connector having a pair of male and female connectors, there is a growing demand for the development of a direct connector that may be directly mounted on a circuit board without a male connector to reduce component costs of the connector and process costs for the existing Surface Mounting Technology (SMT) process.

Meanwhile, since the terminal of the connector transmits one signal to the circuit board per pin, in order to transmit more signals, the number of terminal pins of the connector must be increased and the size of the connector housing must be increased accordingly. For example, FIG. 1 shows an 8-pin connector having 8 terminal pins. In the related art, when a 16-pin connector having a larger number of terminal pins is manufactured, the right and left width of the connector is increased more than twice compared to the 8-pin connector.

If the size of the connector increases, the area of the circuit board on which the connector is mounted increases accordingly, so that the space utilization of the device using the connector and the circuit board may deteriorate.

Thus, it is necessary to develop a direct connector that may be implemented in a compact size with a larger number of terminal pins in comparison to the conventional technique and may be directly mounted on a printed circuit board without a complementary connector.

SUMMARY

Technical Problem

The present disclosure is directed to providing a connector, which may be directly mounted on a circuit board to reduce component costs of the connector and process costs for the existing Surface Mounting Technology (SMT) process.

In addition, the present disclosure is directed to providing a connector, which may be stably fixed to the circuit board even against external impact and vibration to prevent separation or connection fault of the connector and also allow a plurality of components of the connector to be conveniently assembled and disassembled.

Moreover, the present disclosure is directed to providing a connector, which may be implemented with a compact size in comparison to the existing connector.

Technical Solution

In one aspect of the present disclosure, there is provided a PCB direct connector comprising: terminal members arranged in two rows to contact upper conductive patterns provided to an upper surface of a circuit board and lower conductive patterns provided to a lower surface of the circuit board, respectively; and a connector housing configured to accommodate the terminal members therein and configured to allow a connector connection portion formed at an end of a first side of the circuit board to be fitted into and released from the connector housing, wherein the PCB direct connector is directly mounted to a circuit board.

The connector housing may include an upper plate and a lower plate, and respective front portions of the upper plate and the lower plate may be spaced apart from each other by at least a thickness of the circuit board so that the connector connection portion is capable of being inserted therebetween to a predetermined depth, and respective rear portions of the upper plate and the lower plate may be connected to each other to form a single body.

The respective rear portions of the upper plate and the lower plate may include insert holes into which respective pairs of the terminal members are inserted.

The terminal members may include a terminal body having a horizontal body configured to extend toward a portion where a signal transmission cable is connected and a pair of vertical bodies configured to extend in a common direction orthogonal to the horizontal body with a gap having a predetermined width therebetween, the terminal body configured to be interposed in the insert hole; and a contact portion configured to extend from the terminal body so that at least a part of the contact portion has a curved shape to elastically contact the upper surface or the lower surface of the circuit board, the contact portion configured to be interposed at a front portion of the connector housing.

The terminal members may include first-row terminal members and second-row terminal members symmetrically arranged inside the connector housing, the connector housing may include a side hole formed in at least one side surface thereof in a direction intersecting with the insert holes so as to communicate with a space surrounded by terminal bodies of the first-row terminal members and terminal bodies of the second-row terminal members, and the PCB direct connector may further comprise a retainer inserted into the side hole to integrally fix the first-row terminal members and the second-row terminal members.

The connector housing may include a plurality of grooves formed by depressing a surface around the side hole, and the retainer may include a stopper configured to engage with a part of the plurality of grooves.

The upper plate of the connector housing may include a first upper plate portion, a second upper plate portion, and a latch positioned between the first upper plate portion and the second upper plate portion, and the latch may include a hook provided at a first end thereof so as to be hooked to a fastening hole positioned in the circuit board in advance.

The latch may include a shaft configured to protrude orthogonally to an upper surface of the lower plate located between the first upper plate portion and the second upper plate portion; and a latch plate configured to receive the hook, wherein the latch plate extends parallel to the upper plate, the latch plate being connected to the shaft to make a seesawing motion based on a motion of the shaft.

The connector housing may include opposing side surfaces, and each opposing side surface may include a respective substrate holding rib configured to be fitted into a corresponding opposing end of the circuit board based on the connector connection portion.

Each substrate holding rib may be positioned at the rear portion of the upper plate and the rear portion of the lower plate, and each substrate holding rib may include inlets formed with a width greater than the thickness of the circuit board, and the width of the inlets may gradually decrease in a direction along which an end of the circuit board is inserted.

The PCB direct connector may further comprise an insert limit plate positioned at a border of a front portion and a rear portion of the connector housing to extend along a left and right width of the connector housing and form a predetermined wall for partially blocking outlets of the insert holes.

The retainer may further include a terminal support inserted into the side hole and interposed in the connector housing, and the stopper may protrude at one side of the terminal support in a direction intersecting with a direction in which the terminal support extends.

The plurality of grooves of the connector housing may include at least one stopper placing groove configured to engage with the stopper and at least one tool groove configured to receive a predetermined tool inserted therein at a location adjacent to the stopper placing groove.

Advantageous Effects

According to an embodiment of the present disclosure, since the connector may be directly mounted on the circuit board, it is possible to reduce component costs of the connector and process costs for the existing Surface Mounting Technology (SMT) process.

According to another embodiment of the present disclosure, since the connector may be firmly mounted to the circuit board, it is possible to prevent separation or connection fault of the connector with respect to the circuit board even against external impact and vibration.

In addition, components of the connector may be conveniently assembled and disassembled, thereby securing convenient maintenance and management.

Also, it is possible to provide a connector having a compact size compared to the existing connector with the same number of terminals.

It will be clearly understood by those skilled in the art that various embodiments according to the present disclosure can solve various technical problems not mentioned herein.

DETAILED DESCRIPTION

Hereinafter, preferred embodiments of the present disclosure will be described in detail with reference to the accompanying drawings. Prior to the description, it should be understood that the terms used in the specification and the appended claims should not be construed as limited to general and dictionary meanings, but interpreted based on the meanings and concepts corresponding to technical aspects of the present disclosure on the basis of the principle that the inventor is allowed to define terms appropriately for the best explanation.

Therefore, the description proposed herein is just a preferable example for the purpose of illustrations only, not intended to limit the scope of the disclosure, so it should be understood that other equivalents and modifications could be made thereto without departing from the scope of the disclosure.

In the following description, a circuit board may refer to a BMS circuit board that is applied to a battery pack for a vehicle. Here, the BMS circuit board is a component of the battery pack for controlling the charge/discharge and cell balancing of battery cells. The PCB direct connector 5 of the present disclosure may be used to connect to the BMS circuit board and transmit voltage information or the like of the battery cells to the BMS.

The PCB direct connector of the present disclosure may be used to connect to a printed circuit board of an electronic device such as a laptop, a tablet PC and a smart phone in addition to the BMS circuit board and transmit signals required for the electronic device.

Figure 1:
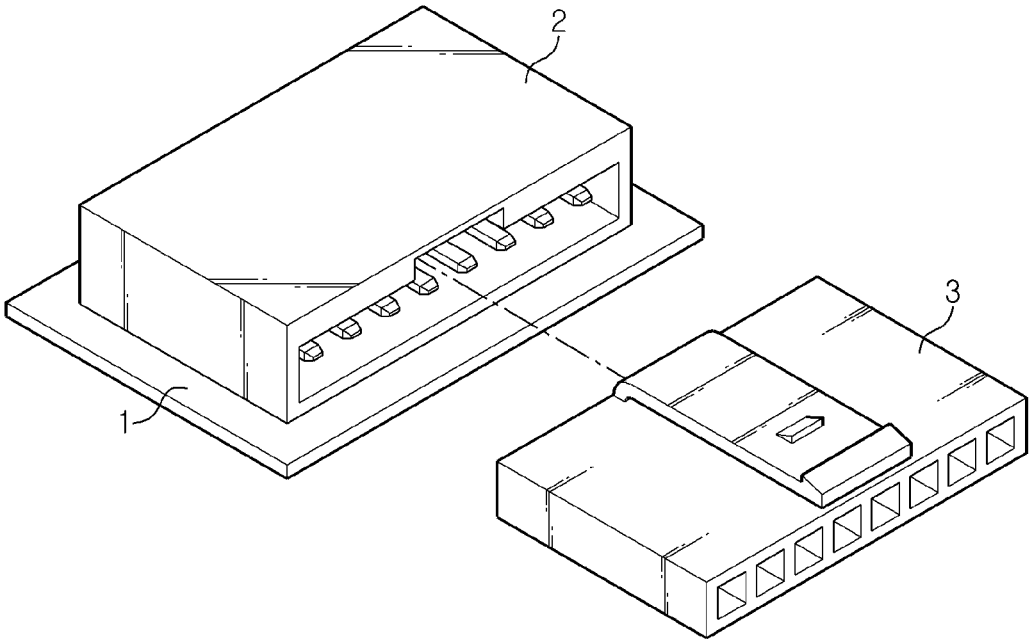
PRIOR ART FIG. 1
FIG. 1 is a diagram schematically showing conventional male and female connectors.
Figure 2:
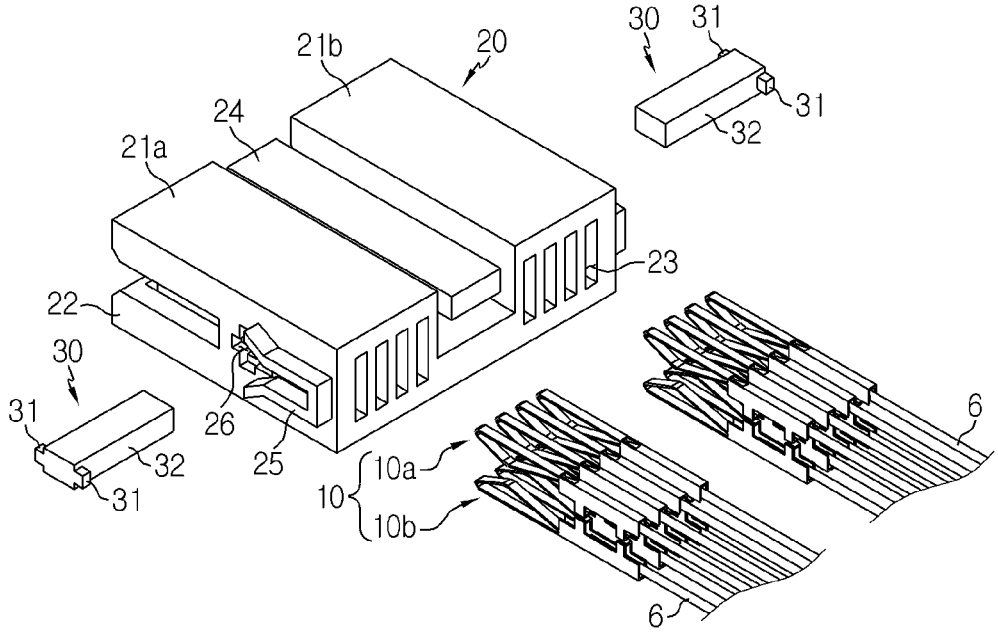
FIG. 2 is an exploded perspective view showing a connector according to an embodiment of the present disclosure.
Figure 3:
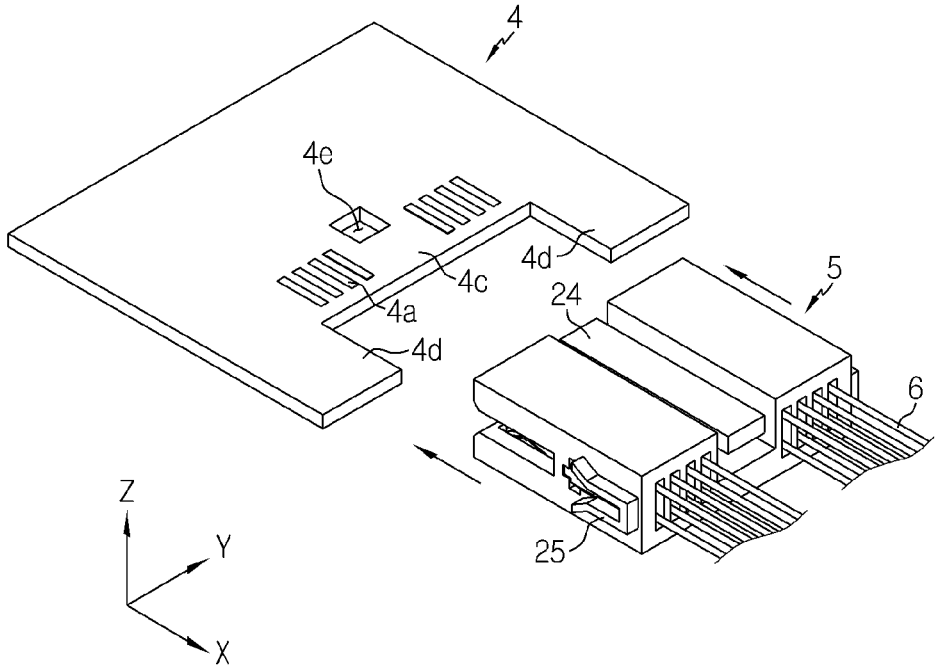
FIGS. 3 and 4 are perspective views showing the connector according to an embodiment of the present disclosure before and after being fastened to a circuit board.
Figure 4:
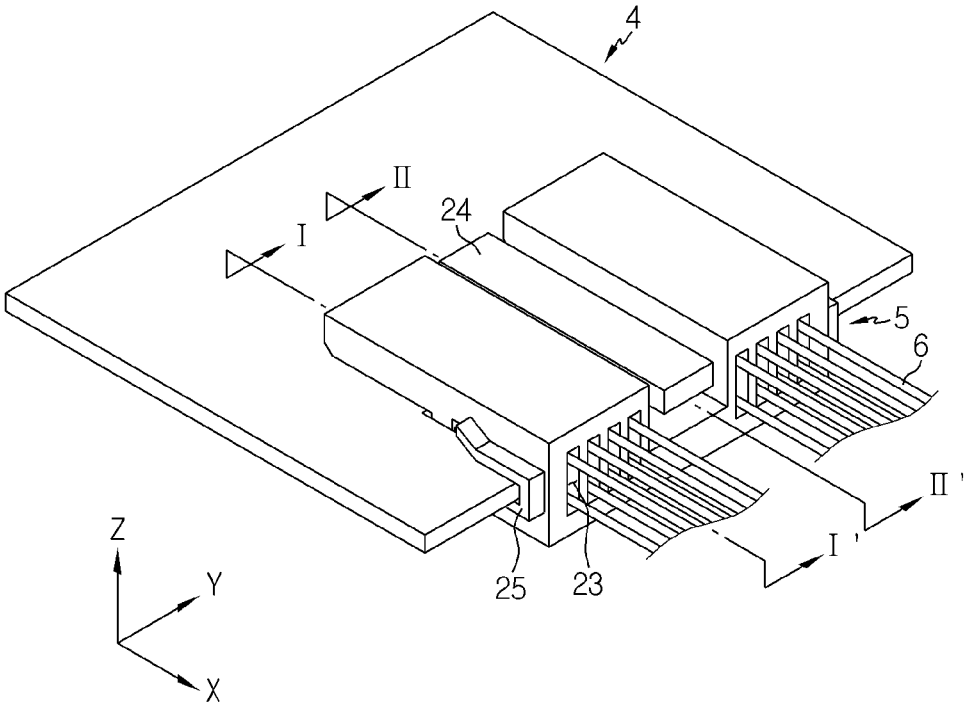

FIG. 2 is an exploded perspective view showing a connector according to an embodiment of the present disclosure, and FIGS. 3 and 4 are perspective views showing the connector according to an embodiment of the present disclosure before and after being fastened to a circuit board.

Referring to the figures, a PCB direct connector 5 according to an embodiment of the present disclosure is connected directly to a circuit board 4 without a male connector, unlike an existing method where a female connector is inserted into a male connector of a circuit board 4 for the connection to the circuit board 4. In this case, the production cost of the male connector and the process cost of mounting the male connector to the circuit board 4 may be reduced.

Seeing components of the PCB direct connector 5 according to an embodiment of the present disclosure, as shown in FIG. 2, the PCB direct connector 5 includes terminal members 10, a connector housing 20 and a retainer 30.

The terminal members 10 are electrically conductive metallic components used to easily connect signal transmission cables 6 to conductive patterns of the circuit board 4.

In particular, the terminal members 10 according to this embodiment are assembled to the connector housing 20 in a two-row structure. For example, referring to FIGS. 2 and 6 together, the terminal members 10 include first-row terminal members 10*a* and second-row terminal members 10*b*, and the first-row terminal members 10*a* and the second-row terminal members 10*b* are symmetrically arranged to be spaced apart from each other inside the connector housing 20. The first-row terminal member 10*a* contacts an upper conductive pattern 4*a* provided on the upper surface of the circuit board 4, and the second-row terminal member 10*b* contacts a lower conductive pattern 4*b* provided on the lower surface of the circuit board 4, respectively, to transmit different signals to the circuit board 4.

If the conductive patterns 4*a*, 4*b* are formed on both surfaces of the circuit board 4 and the terminal members 10 are arranged in two rows inside the connector housing 20 to contact the conductive patterns 4*a*, 4*b* as described above, the right and left width of the connector housing 20 may be reduced by half compared to the existing connector housing 20 having a one-row structure.

Since the first-row terminal members 10*a* and the second-row terminal members 10*b* are symmetrically arranged in the same configuration, just one of them will be described.

Figure 6:
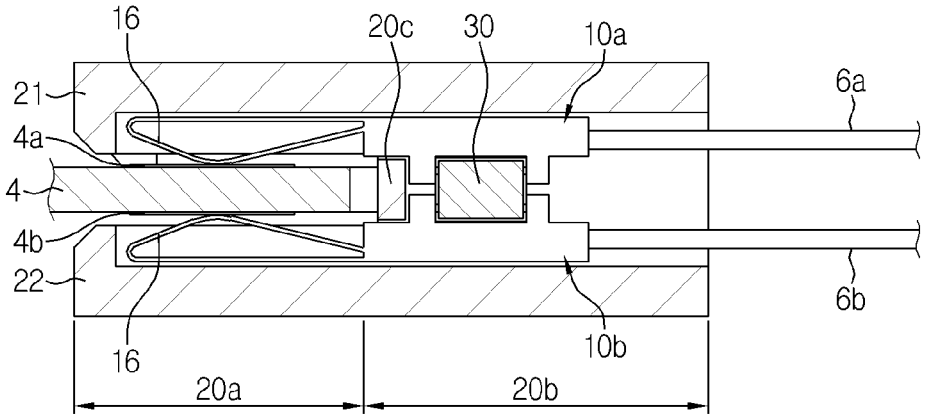
FIG. 6 is a cross-sectioned view, taken along the line I-I' of FIG. 4.
Figure 7:
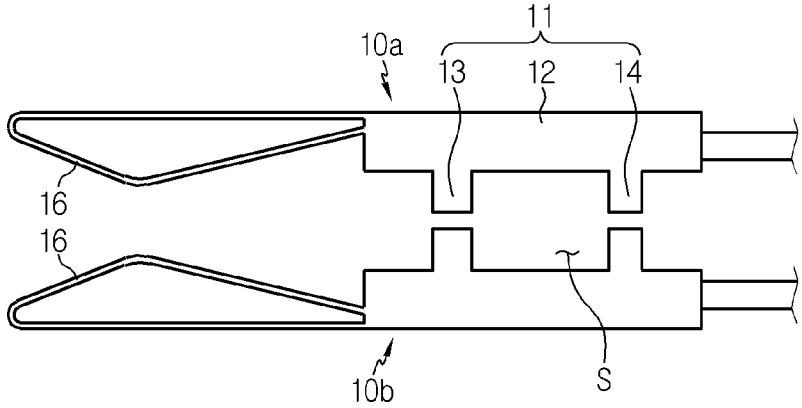
FIG. 7 is a diagram showing the terminal members of FIG. 6.
Figure 8:
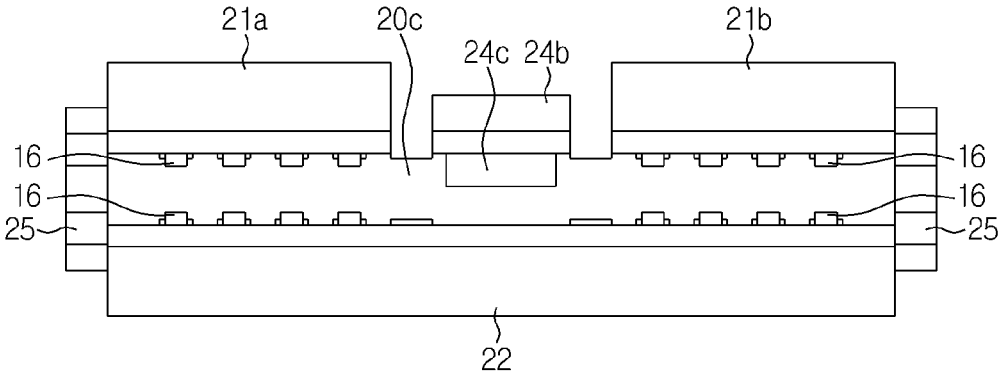
FIG. 8 is a front view showing the connector according to an embodiment of the present disclosure.
Figure 9:
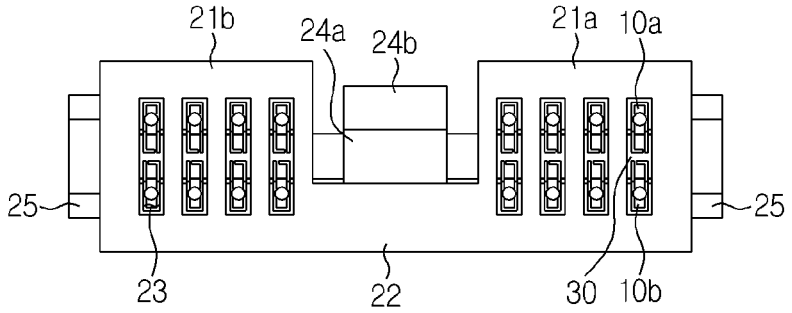
FIG. 9 is a rear view showing the connector according to an embodiment of the present disclosure.
Figure 10:
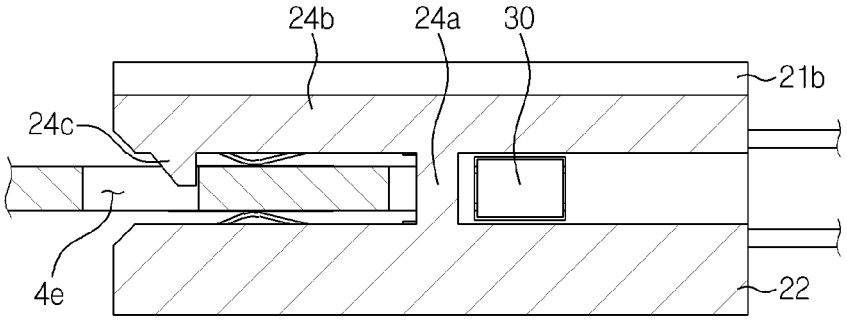
FIG. 10 is a cross-sectioned view, taken along the line II-II' of FIG. 4.
Figure 11:
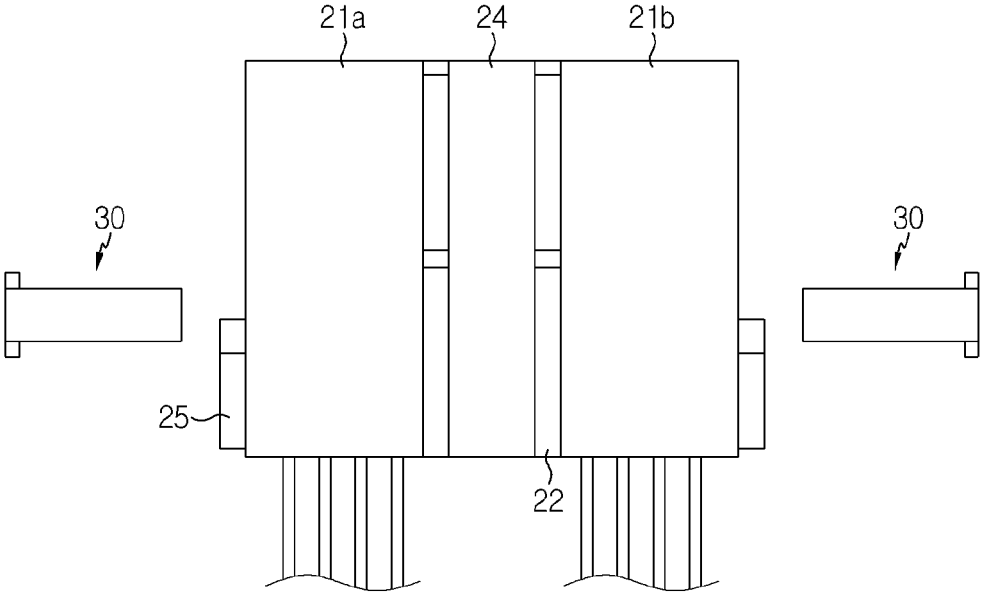
FIGS. 11 to 13 are diagrams for illustrating a coupling relationship of the connector housing and the retainer.

Referring to FIGS. 2, 6 and 7 together, the terminal member 10 includes a terminal body 11 and a contact portion 16.

The terminal body 11 of this embodiment includes a horizontal body 12 extending toward a portion where the signal transmission cable 6 is connected, and a pair of vertical bodies 13, 14 extending in the same direction orthogonal to the horizontal body 12 with a predetermined gap therebetween.

The signal transmission cable 6 may be connected to the horizontal body 12, and the retainer 30 may be interposed later in a fitting space S formed between the pair of vertical bodies 13, 14. The retainer 30 may prevent the terminal members 10 from moving inside the connector housing 20 as explained in detail later.

The contact portion 16 may be provided in a cantilever shape extending from the terminal body 11 and having at least a portion curved to elastically contact the surface of the circuit board 4. The contact portions 16 of the terminal members 10 may contact the upper conductive patterns 4*a* and the lower conductive patterns 4*b* of the circuit board 4, respectively, when the direct connector 5 is mounted on the circuit board 4. At this time, the interval between the curved portion of the contact portion 16 of the first-row terminal member 10*a* and the curved portion of the contact portion 16 of the second-row terminal member 10*b* is smaller than the thickness of the circuit board 4 so that the contact portions 16 may elastically contact the upper conductive patterns 4*a* and the lower conductive patterns 4*b*.

Meanwhile, the direct connector 5 according to the present disclosure may be fastened to the circuit board 4 without a male connector, but the direct connector 5 may also be applied to a circuit board 4 in which a predetermined fastening hole 4*e* and conductive patterns are provided at both surfaces thereof in advance.

Hereinafter, one side of an end of the circuit board 4 having the conductive patterns 4*a*, 4*b* at both surfaces thereof will be referred to as a connector connection portion 4*c*. In addition, the connector connection portion 4*c* is preferably formed concave into the circuit board 4 as shown in FIG. 3.

The connector housing 20 accommodates the terminal members 10 therein and is provided so that the connector connection portion 4*c* of the circuit board 4 may be fitted into and released from the connector housing 20. In other words, the connector housing 20 and the connector housing portion 4*c* of the circuit board 4 are provided to be coupled to and released from each other in a slot manner.

Referring to FIGS. 3 to 9, the connector housing 20 includes an upper plate 21 and a lower plate 22, which form an accommodation space of the terminal members 10, and a latch 24 and a substrate holding rib 25, which form a locking means for the circuit board 4.

The upper plate 21 and the lower plate 22 may be regarded as a part forming a body of the connector housing 20.

The upper plate 21 and the lower plate 22 are spaced apart from each other as much as at least the thickness of the circuit board 4 so that the connector connection portion 4*c* is inserted therebetween to a predetermined depth, and rear portions 20*b* of the upper plate 21 and the lower plate 22 are connected to each other to form a single body. In addition, at the rear portions 20*b* of the upper plate 21 and the lower plate 22, insert holes 23 for individually inserting the pair of first-row and second-row terminal members 10*a*, 10*b* are formed. Here, each pair of first-row and second-row terminal members 10*a*, 10*b* includes the first-row terminal member 10*a* and the second-row terminal member 10*b*. The first-row and second-row terminal members 10*a*, 10*b* may be inserted through the corresponding insert holes 23 to the front portion 20*a* of the connector housing behind the connector housing 20.

More specifically, an insert limit plate 20*c* extending along the left and right width of the connector housing 20 to partially block the outlet of the insert holes 23 may be provided to a border between the front portion 20*a* and the rear portion 20*b* of the connector housing 20. The contact portions 16 may move out through the insert holes 23 and the gap between the insert limit plate 20*c* and be disposed at the front portion 20*a* of the connector housing 20, and the terminal bodies may be blocked by the insert limit plate 20*c* and thus disposed at the rear portion 20*b* of the connector housing 20.

According to the configuration of the connector housing 20, since the rear portion 20*b* of the connector housing 20 is blocked by the insert limit plate 20*c* as shown in FIG. 6, the connector connection portion 4*c* of the circuit board 4 may be inserted up to the front portion 20*a* of the connector housing 20, and the upper surface and the lower surface of the connector connection portion 4*c* may elastically contact the contact portion 16 of the first-row terminal member 10*a* and the contact portion 16 of the second-row terminal member 10*b*. For reference, the contact portions 16 of the different terminal members 10 neighboring in the Y-axis direction are partially inserted into guide grooves provided at the upper plate 21 and the lower plate 22 of the front portion 20*a* of the connector housing 20, respectively, to maintain the creepage distance constant, thereby preventing a short circuit.

The latch 24 is hooked to the fastening hole 4*e* provided in the circuit board 4 in advance to hold the connector housing 20 not to be released from the connector connection portion 4*c* in a reverse direction (+X-axis direction).

In this embodiment, the upper plate 21 of the connector housing 20 is divided into a first upper plate 21*a* and a second upper plate 21*b*, and the latch 24 is provided between the first upper plate 21*a* and the second upper plate 21*b*.

Referring to FIGS. 3, 4, 8 to 10 together, the latch 24 includes a shaft 24*a* protruding orthogonal to the upper surface of the lower plate 22, a latch plate 24*b* connected to the shaft 24*a* and extending parallel to the upper plate 21, and a hook 24*c* provided at one end of the latch plate 24*b*. The hook 24*c* may be vertically inserted into the fastening hole 4*e* provided at the circuit board 4 and be bent orthogonal to the latch plate 24*b* so as to be hooked in the fastening hole 4*e*.

The latch plate 24*b* is supported by the shaft 24*a* at a predetermined gap away from the lower plate 22, and the shaft 24*a* is located approximately at the center of the latch plate 24*b*. The latch plate 24*b* may make a seesawing operation based on the shaft 24*a*. If the latch 24 is used, when it is intended to remove the connector housing 20 from the circuit board 4, a user may simply press the other end of the latch plate 24*b* to release the hooking between the hook 24*c* and the fastening hole 4*e* and then pull the connector housing 20 in the reverse direction.

The substrate holding rib 25 holds the connector housing 20 not to move in the upper, lower, left and right directions (±Y-axis and ±Z-axis directions) relative to the circuit board 4. Here, it is assumed that the circuit board 4 is configured such that the substrate holding rib 25 may be applied thereto. That is, the circuit board 4 is assumed such that the connector connection portion 4*c* has a width corresponding to the upper plate 21 and the lower plate 22 of the connector housing 20 and is concavely recessed into the circuit board 4.

Figure 5:
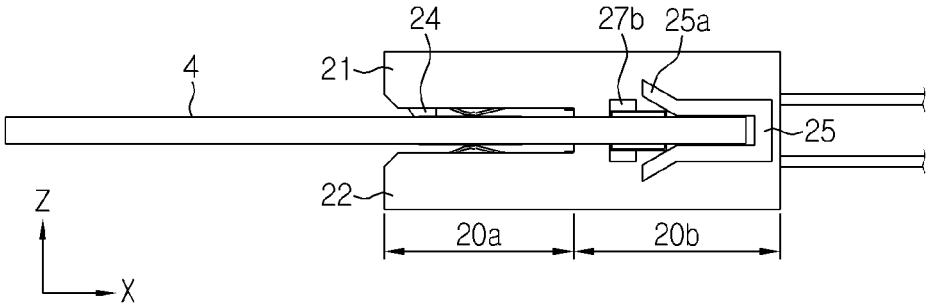
FIG. 5 is a side view of FIG. 4.

As shown in FIGS. 3 to 5, the substrate holding ribs 25 according to this embodiment are located at both side surfaces of the connector housing 20 and have an inner width corresponding to the thickness of the circuit board 4 such that the end portions of the circuit board 4 adjacent to both sides of the connector connection portion 4*c* are fitted therein. Here, the end portion of the circuit board 4 will be referred to as a rib connection portion 4*d*.

When the front portion 20*a* of the connector housing 20 is pushed into the connector connection portion 4*c* of the circuit board 4, since the rib connection portions 4*d* are fitted into the substrate holding ribs 25, the connector housing 20 may be tightly fixed to the circuit board 4.

In particular, the substrate holding ribs 25 may be provided at the rear portion 20*b* of the connector housing 20, namely at the rear portions 20*b* of the upper plate 21 and the lower plate 22 whose side surfaces are blocked. In this case, when the connector housing 20 is fully pushed into the connector connection portion 4*c*, the rear portion 20*b* of the connector housing 20 is tightly interposed in the space between the rib connection portions 4*d* so that both side surfaces thereof are supported in the left and right direction by the rib connection portion 4*d*. Thus, the connector housing 20 may be fixed not to move in the left and right direction (±Y-axis direction) with respect to the circuit board 4 even if there is vibration or impact.

In addition, the substrate holding ribs 25 have an inlet 25*a* having a width greater than the thickness of the circuit board 4. The inlet 25*a* may have a width gradually decreasing in a direction along which the end of the circuit board 4 is inserted. If the inlet 25*a* of the substrate holding rib 25 is provided as above, the inlet 25*a* of the substrate holding rib 25 having a greater width may be easily matched with the front end of the rib connection portion 4*d*. In addition, even if the front end of the rib connection portion 4*d* is slightly misaligned from the center of the inlet 25*a* of the substrate holding rib 25 while being fitted, since the width of the inlet 25*a* gradually decreases, the rib connection portion 4*d* may be guided suitable for the inner width of the substrate holding rib 25. Thus, according to the configuration of the substrate holding rib 25, the direct connector 5 may be accurately aligned and mounted to the circuit board 4.

Meanwhile, the direct connector 5 according to an embodiment of the present disclosure is a connector for connecting to the BMS circuit board 4 applied to a battery pack for a vehicle, and further includes a retainer 30 for holding the terminal members 10 not to move.

More specifically, the retainer 30 may play a role of holding the terminal members 10 not to move in the positive and reverse directions (±X-axis direction) and supporting the first-row terminal members 10*a* and the second-row terminal members 10*b* in the up and down directions (±Z-axis direction) not to be shorted.

Referring to FIGS. 2, 6, 11 to 13, a side hole 26 communicating with the fitting space S surrounded by the terminal bodies 11 of the first-row terminal members 10*a* and the terminal bodies 11 of the second-row terminal members 10*b* disposed in the insert holes 23 may be provided to at least one side surface of the connector housing. Namely, in this embodiment, the side hole 26 is formed in both side surfaces of the connector housing to communicate with the insert holes 23 in an intersecting direction.

The retainer 30 may be inserted into the side surface of the connector housing 20 one by one (in the Y-axis direction) through the side hole 26 and is interposed in the fitting space S formed between the first-row terminal body 11 and the second-row terminal body 11 disposed in the insert hole 23.

As described above, the upper plate 21 of the connector housing 20 of this embodiment is divided into the first upper plate 21*a* and the second upper plate 21*b* with the latch 24 being interposed therebetween, and the terminal members 10 are also divided into a first group and a second group with the latch 24 being interposed therebetween. Thus, in this embodiment, two side holes 26 are formed, one in each of both side surfaces of the connector housing 20, and two retainers 30 are used to fix the terminal members 10 of the first group and the second group. For reference, unlike this embodiment, the two side holes 26 may be in communication with each other, and thus it is possible to extend one retainer 30 long so that the terminal members 10 of the first group and the second group are integrally fixed using a single retainer 30.

In addition, the retainer 30 according to this embodiment includes a terminal support 32 and a stopper 31. The terminal support 32 is interposed in the connector housing 20 through the side hole 26 to support the terminal members 10, and the stopper 31 protrudes on one side of the terminal support 32 to limit an insertion depth of the retainer 30. The stopper 31 may be hooked around the inlet of the side hole 26.

Figure 12:
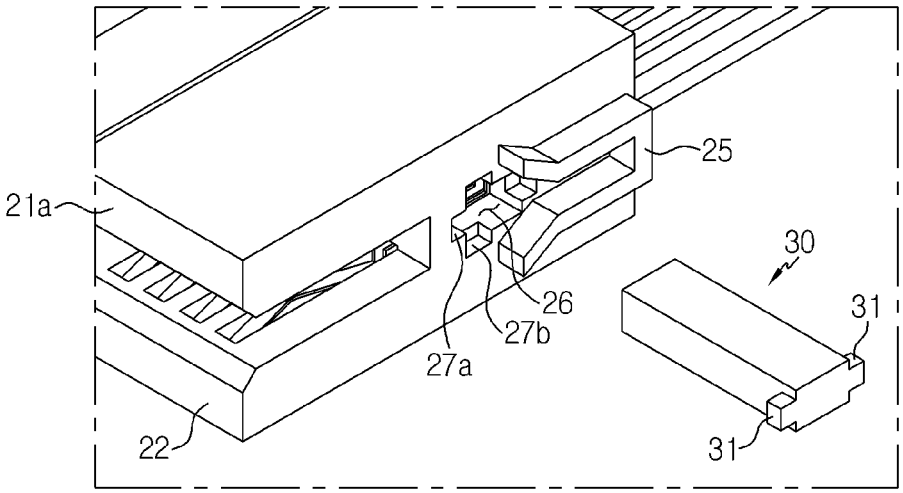

That is, as shown in FIG. 12, a plurality of grooves formed by depressing a surface may be provided around the side hole 26. In FIG. 12, among the plurality of grooves, the grooves located to the left and right of the inlet of the side hole 26 are stopper placing grooves 27*a*, and the grooves located at the top and bottom thereof are tool grooves 27*b*.

The retainer 30 may be inserted into the side hole 26 until the stopper 31 engages with the stopper placing groove 27*a*. That is, the insertion depth of the retainer 30 into the side hole 26 may be limited as the stopper 31 is caught by the stopper placing groove 27*a*. In the retainer 30 of this embodiment, since the stopper 31 is provided at one end thereof, the retainer 30 may be inserted into the side hole 26 until one end of the retainer 30 is located on the same plane as the side surface of the connector housing 20. In other words, the retainer 30 fully inserted into the side hole 26 may be regarded as being buried in the side surface of the connector housing 20.

Figure 13:
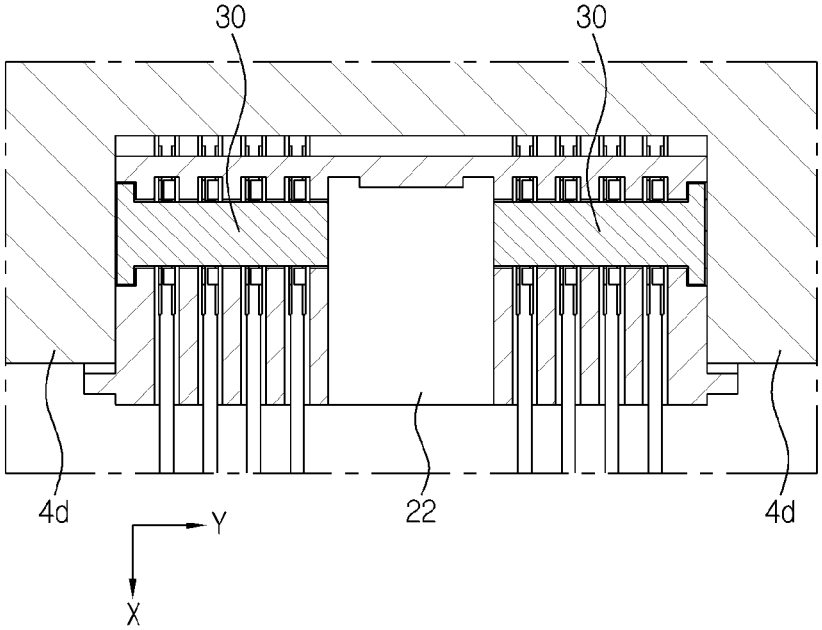

As shown in FIG. 13, when the direct connector 5 is pushed into the connector connection portion 4*c*, the retainer 30 is blocked by the side surface of the rib connection portion 4*d* and cannot escape in the ±Y-axis direction. According to this configuration, it is not necessary to give a fastening such as a hooking structure to the connector housing 20 and the retainer 30 in order to fix the retainer 30 to the connector housing 20. Meanwhile, in order to separate the retainer 30 from the connector housing 20, it is enough to insert a predetermined tool into the tool groove 27*b* and just pull the retainer 30.

According to the configuration of the direct connect of this embodiment as described above, since the terminal members 10 may be assembled in two rows in the connector housing 20, the connector may be implemented to have a half size compared to the existing connector, and also it is possible to prevent the connector from being separated or erroneously contacted even under the vibration and shock conditions.

In addition, since the terminal members 10, since the connector housing 20 and the retainer 30 of the direct connector 5 are assembled and disassembled in a simple way, components the connector may be easily maintained and managed when necessary.

If the configuration of the PCB direct connector 5 according to an embodiment of the present disclosure as described above is used, it is possible to simplify the structure and manufacturing process of the connector and reduce the manufacturing cost thereof, compared to the existing male and female pair of connectors, and the PCB direct connector 5 may be robustly mounted to the circuit board 4, thereby preventing the connector from being detached or badly contacted even in an environment where vibration or shock is applied.

The present disclosure has been described in detail. However, it should be understood that the detailed description and specific examples, while indicating preferred embodiments of the disclosure, are given by way of illustration only, since various changes and modifications within the scope of the disclosure will become apparent to those skilled in the art from this detailed description.

Meanwhile, when the terms indicating up, down, left and right directions are used in the specification, it is obvious to those skilled in the art that these merely represent relative locations for convenience in explanation and may vary based on a location of an observer or an object to be observed.

What is claimed is:

1. A PCB direct connector comprising:

terminal members arranged in two rows to contact upper conductive patterns provided to an upper surface of a circuit board and lower conductive patterns provided to a lower surface of the circuit board, respectively;

a connector housing configured to accommodate the terminal members therein and configured to allow a connector connection portion formed at an end of a first side of the circuit board to be fitted into and released from the connector housing; and a latch positioned on the connector housing, wherein the latch includes a hook at a first end thereof so as to be hooked to a fastening hole positioned in the circuit board, wherein the PCB direct connector is directly mounted to the circuit board by the latch.

2. The PCB direct connector according to claim 1, wherein the connector housing includes an upper plate and a lower plate, and wherein respective front portions of the upper plate and the lower plate are spaced apart from each other by at least a thickness of the circuit board so that the connector connection portion is capable of being inserted therebetween to a predetermined depth, and wherein respective rear portions of the upper plate and the lower plate are connected to each other to form a single body.

3. The PCB direct connector according to claim 2, wherein the respective rear portions of the upper plate and the lower plate include insert holes into which respective pairs of the terminal members are inserted.

4. The PCB direct connector according to claim 3, wherein the terminal members include:

a terminal body having:

a horizontal body configured to extend toward a portion where a signal transmission cable is connected; and a pair of vertical bodies configured to extend in a common direction orthogonal to the horizontal body with a gap having a predetermined width therebetween, wherein the terminal body is configured to be interposed in the insert hole; and a contact portion configured to extend from the terminal body so that at least a part of the contact portion has a curved shape to elastically contact the upper surface or the lower surface of the circuit board, wherein the contact portion is configured to be interposed at a front portion of the connector housing.

5. The PCB direct connector according to claim 4, wherein the terminal members include first-row terminal members and second-row terminal members symmetrically arranged inside the connector housing, wherein the connector housing includes a side hole formed in at least one side surface thereof in a direction intersecting with the insert holes so as to communicate with a space surrounded by terminal bodies of the first-row terminal members and terminal bodies of the second-row terminal members, and wherein the PCB direct connector further comprises a retainer inserted into the side hole to integrally fix the first-row terminal members and the second-row terminal members.

6. The PCB direct connector according to claim 5, wherein the connector housing includes a plurality of grooves formed by depressing a surface around the side hole, and wherein the retainer includes a stopper configured to engage with a part of the plurality of grooves.

7. The PCB direct connector according to claim 2,
wherein the upper plate of the connector housing includes a first upper plate portion, a second upper plate portion, and the latch, and wherein the latch is positioned between the first upper plate portion and the second upper plate portion.

8. The PCB direct connector according to claim 7,
wherein the latch includes:
a shaft configured to protrude orthogonally to an upper surface of the lower plate positioned between the first upper plate portion and the second upper plate portion; and
a latch plate configured to receive the hook, wherein the latch plate extends parallel to the upper plate, the latch plate being connected to the shaft to make a seesawing motion based on a motion of the shaft.

9. The PCB direct connector according to claim 2,
wherein the connector housing includes opposing side surfaces, and wherein each opposing side surface includes a respective substrate holding rib configured to be fitted into a corresponding opposing end of the circuit board based on the connector connection portion.

10. The PCB direct connector according to claim 9,
wherein each substrate holding rib is positioned at the rear portion of the upper plate and the rear portion of the lower plate, and
wherein each substrate holding rib includes inlets formed with a width greater than the thickness of the circuit board, and wherein the width of the inlets gradually decreases in a direction along which an end of the circuit board is inserted.

11. The PCB direct connector according to claim 3, further comprising:
an insert limit plate positioned at a border of a front portion and a rear portion of the connector housing to extend along a left and right width of the connector housing and form a predetermined wall for partially blocking outlets of the insert holes.

12. The PCB direct connector according to claim 6,
wherein the retainer further includes a terminal support inserted into the side hole and interposed in the connector housing, and wherein the stopper protrudes at one side of the terminal support in a direction intersecting with a direction in which the terminal support extends.

13. The PCB direct connector according to claim 6,
wherein the plurality of grooves of the connector housing include:
at least one stopper placing groove configured to engage with the stopper; and
at least one tool groove configured to receive a predetermined tool inserted therein at a location adjacent to the stopper placing groove.

14. A PCB direct connector comprising:
terminal members arranged in two rows to contact upper conductive patterns provided to an upper surface of a circuit board and lower conductive patterns provided to a lower surface of the circuit board, respectively; and
a connector housing configured to accommodate the terminal members therein and configured to allow a connector connection portion formed at an end of a first side of the circuit board to be fitted into and released from the connector housing,
wherein the PCB direct connector is directly mounted to a circuit board, and
wherein the connector housing includes opposing side surfaces, and wherein each opposing side surface includes a respective substrate holding rib configured to be fitted into a corresponding opposing end of the circuit board based on the connector connection portion.

15. The PCB direct connector according to claim 14,
wherein the connector housing includes an upper plate and a lower plate,
wherein respective front portions of the upper plate and the lower plate are spaced apart from each other by at least a thickness of the circuit board so that the connector connection portion is capable of being inserted therebetween to a predetermined depth, and wherein respective rear portions of the upper plate and the lower plate are connected to each other to form a single body,
wherein each substrate holding rib is positioned at the rear portion of the upper plate and the rear portion of the lower plate, and
wherein each substrate holding rib includes inlets formed with a width greater than the thickness of the circuit board, and wherein the width of the inlets gradually decreases in a direction along which an end of the circuit board is inserted.

* * * * *